US011649674B2

(12) United States Patent
Valkenburg

(10) Patent No.: US 11,649,674 B2
(45) Date of Patent: May 16, 2023

(54) OPERATING MECHANISM FOR A CORDLESS WINDOW COVERING

(71) Applicant: VAKO B.V., Hertogenbosch (NL)

(72) Inventor: Nanne Willem Valkenburg, Vught (NL)

(73) Assignee: VAKO B.V., Ga's-Hertogenbosch (NL)

( * ) Notice: Subject to any disclaimer, the term of this patent is extended or adjusted under 35 U.S.C. 154(b) by 123 days.

(21) Appl. No.: 17/141,630

(22) Filed: Jan. 5, 2021

(65) Prior Publication Data

US 2021/0207435 A1 Jul. 8, 2021

(30) Foreign Application Priority Data

Jan. 6, 2020 (NL) ..... 2024607

(51) Int. Cl.
*E06B 9/78* (2006.01)
*E06B 9/80* (2006.01)

(52) U.S. Cl.
CPC ..... *E06B 9/78* (2013.01); *E06B 9/80* (2013.01); *E06B 2009/801* (2013.01); *E06B 2009/807* (2013.01)

(58) Field of Classification Search
CPC ..... E06B 9/78; E06B 9/80; E06B 2009/801; E06B 2009/807; E06B 9/322; E06B 9/42
See application file for complete search history.

(56) References Cited

U.S. PATENT DOCUMENTS

| | | | | |
|---|---|---|---|---|
| 7,665,507 | B2 * | 2/2010 | Naoki | E06B 9/78 160/170 |
| 10,774,586 | B2 * | 9/2020 | Smith | E06B 9/322 |
| 2010/0018655 | A1 * | 1/2010 | Nakajima | F16D 51/40 160/296 |
| 2014/0130989 | A1 * | 5/2014 | Chan | E06B 9/90 242/389 |
| 2017/0051559 | A1 * | 2/2017 | Anthony | E06B 9/80 |
| 2020/0332596 | A1 * | 10/2020 | Sonzini | E06B 9/90 |

FOREIGN PATENT DOCUMENTS

| | | |
|---|---|---|
| CA | 1082587 | 7/1980 |
| CN | 107191126 A | 9/2017 |
| CN | 109386228 A | 2/2019 |

OTHER PUBLICATIONS

Search Report and Written Opinion dated Sep. 11, 2020 issued in corresponding Dutch Application No. NL2024607.

* cited by examiner

*Primary Examiner* — Beth A Stephan
(74) *Attorney, Agent, or Firm* — Nath, Goldberg & Meyer; Joshua B. Goldberg

(57) ABSTRACT

The invention relates to an operating mechanism for a cordless window covering such as a roller blind, comprising at least one substantially stationary inner shaft which is connectable to the fixed world and at least one axially rotatable drive shaft configured for driving and thereby lowering and/or raising the window covering. The system is in particular configured to provide controlled operation of a cordless window covering.

20 Claims, 4 Drawing Sheets

OPERATING MECHANISM FOR A CORDLESS WINDOW COVERING

TECHNICAL FIELD

The invention relates to an operating mechanism for a cordless window covering.

The invention also relates to an assembly of a window covering and such operating mechanism.

BACKGROUND ART

There are European regulations regarding the safety of window coverings in place in order to prevent injuries to people, and in particular children. The aim of these so-called child-safety regulations is, inter alia, to prevent children from suffocating as a result of becoming trapped in the loop of a cord or a chain. A known measure to meet these is the provision of a window covering in which the operating mechanism is provided with a drive wheel provided with a cord or chain which is removably accommodated in a housing of the operating mechanism. If excessive force is applied to the cord or the chain, and thus to the drive wheel, the cord or the chain will be removed from the housing, together with the drive wheel. By means of such a device, it is possible to prevent a child from becoming entangled with the cord and suffering serious injuries as a result. Another example to meet the child-safety regulation is by providing a cordless operating mechanism for window shades or window blinds. Such cordless mechanisms or systems can typically be operated manually and provide for a controlled lifting and lowering of a bottom rail of the window shade or blind or via electrically controlled lifting and lowering of said window shade.

SUMMARY OF THE INVENTION

It is an object of the invention to provide an improved operating mechanism for a relatively child-safe window covering or at least to provide an alternative to the known operating mechanism for (cordless) window coverings.

The invention provides thereto an operating mechanism for a cordless window covering such as a roller blind, comprising at least one substantially stationary inner shaft which is (directly or indirectly) connectable to the fixed world, at least one at least partially conically shaped coupling structure which encloses at least part of the inner shaft, at least one urging element configured for urging the coupling structure in axial direction of the inner shaft, at least one axially rotatable drive shaft configured for driving and thereby lowering and/or raising the window covering, wherein the drive shaft encloses at least part of the inner shaft and the coupling structure, and at least one brake shoe configured to cooperate with at least the conically shaped part of the coupling structure and with the axially rotatable drive shaft, wherein the brake shoe, the coupling structure and the drive shaft are positioned such that axially urging of the coupling structure by the urging element causes a radially outward force onto the brake shoe causing the brake shoe to at least partially impede rotation of the axially rotatable drive shaft.

The operating mechanism is typically configured to be manually activated and/or operated via raising or lowering of the window covering. Raising or lowering of the window covering will in doing so cause (either directly or indirectly) a rotational movement of the axially rotatable shaft. Upon rotation of the axially rotatable drive shift, a window covering which is directly or indirectly connected to the drive shaft, will be wound or unwound with respect to the drive shaft. Hence, winding or unwinding of the window covering will respectively be related to lifting or lowering of said window covering. The operating mechanism according to the present invention has several advantages. The smart cooperation between in particular the at least one at least partially conically shaped coupling structure, at least one brake shoe and at least one drive shaft results in an improved controllability of the window covering. During use, the coupling structure experiences a continuous axial force due to being urged in axial direction by the urging element. When the term 'urging' is used it can also be said that the coupling structure is forced, in particular resiliently forced, in axial direction by the urging element. The conical part of the coupling structure enables that also a radial force component is obtained. In fact, due to the cooperation between the conical part of the coupling structure and the brake shoe, the axial force causes a (continuous) radially outward force onto the brake shoe. The brake shoe can provide a braking effect onto the drive shaft due to this radially outward force experienced by the brake shoe. Hence, the radially outward force of the brake shoe onto the drive shaft can contribute to impeding, or slowing down, the rotational movement of the axially rotatable drive shaft. The continuous braking force onto the drive shaft may also contribute to providing a stable and/or balanced equilibrium situation of the window covering in case the window covering is not (actively) raised or lowered. Hence, the operating mechanism, and thus also the window covering device as such, does not require any additional locking elements. Application of an additional locking element typically requires an additional manual act during use of the operating mechanism. Hence, the configuration according to the invention results in a more simplistic operating mechanism and is further advantageous for the ease of use as less manual acts are required for controlling the mechanism.

Typically, at least part of the outer surface of the coupling structure is conically shaped. However, it is also conceivable that the coupling structure is substantially entirely conically shaped. The coupling structure is typically only (slightly) displaceable in axial direction. The coupling structure is more typically displaceable in axial direction over a predetermined distance. Rotation of the coupling element during use is typically, and preferably, prohibited. It is conceivable that in a possible embodiment, the brake shoe (slightly) rotates during use. However, the brake shoe should preferably not follow the full rotation of the drive shaft. The brake shoe typically (either directly or indirectly) engages both the conical part of the coupling structure and the drive shaft, in particular an inner surface of the drive shaft. As indicated above, this results in the ability of obtaining a continuous braking force and also in providing a stable and/or balanced equilibrium situation of the window covering in case the window covering is not (actively) raised or lowered. The drive shaft may for example be substantially hollow. The drive shaft can surround at least part of the further components of the operating mechanism. Typically, the drive shaft encloses at least part of the inner shaft and the coupling structure but also at least one brake shoe and/or at least one urging element. Herewith, a relatively compact embodiment of the operating mechanism can be provided. A further benefit of the operating mechanism according to the present invention is that the drive shaft can be provide a shielding function.

In a possible embodiment of the operating mechanism according to the present invention, the urging element is configured for urging the coupling structure in axial direction of the inner shaft towards the center of the window covering. In other words, the urging element is configured for urging the coupling structure in axial direction of the inner shaft facing away from a nearest outer end of the inner shaft (and/or the drive shaft). Typically, at least one operating element is positioned substantially at an outer end of the window covering. Hence in such embodiment, preferably the coupling structure is urged in a direction facing away from the outer end, in particular towards the other outer end of the window covering. Such embodiment is preferred from manufactural point of view.

The coupling structure is preferably positioned such that the outer diameter of at least the conically shaped part of the coupling structure decreases in the direction wherein it is axially urged by the urging element. This means that the outer diameter of at least the conically shaped part of the coupling structure decreases towards the center of the window covering. In particular, the outer diameter of at least the conically shaped part of the coupling structure increases towards the closest outer end of the window covering. An advantage of this embodiment is that it may further ensure that the brake shoe can provide a sufficient brake force in a continuous manner. Even if the brake shoe would experience wear, the continuous axial force of the coupling structure could cause the conically shaped part of the coupling structure to adapt to the alteration of the brake shoe due to the decreasing diameter.

Typically, at least part of the coupling structure is hollow, as the coupling structure is configured to enclose at least part of the inner shaft. It is also conceivable that at least part of the coupling structure is frusto conical. Further, at least part of the substantially stationary inner shaft may have a non-cylindrical shape and part of an inner surface of the coupling structure, in particular the conically shaped part thereof, may have a complementary non-cylindrical shape. Such complementary shapes may prevent rotation of the coupling structure, in particular with respect to the inner shaft. This is beneficial in order to ensure that the coupling structure is only axially displaceable. Rotational movement of the coupling structure may negatively influence or even prohibit the desired (continuous) braking force. It is in a further embodiment possible that the substantially stationary inner shaft comprises at least one non-cylindrical part and at least one (adjacent) cylindrical part. The presence of a cylindrical part may be beneficial for the corporation between the inner shaft and the urging element, for example in case the urging element is formed by a coil spring which surrounds the (cylindrical) part of the inner shaft.

In a further possible embodiment, the coupling structure may comprise a substantially cylindrical part configured to enclose at least part of the urging element. Such substantially cylindrical part may for example be (integrally) connected to the conically shaped part of the coupling structure. The substantially cylindrical part can provide a protective function for the urging element which would be beneficial for the durability of the operating mechanism.

In another beneficial embodiment of the operating mechanism, the substantially stationary inner shaft comprises at least one stop surface configured to form a stop for the urging element. This embodiment enables the use of a rather simplistic urging element. Such stop surface can for example be at least one flange, protrusion, rim, edge, projection and/or a combination of such. The stop surface can be connected to the inner shaft. It is however also possible that the stop surface forms integrally part of the inner shaft. Due to the stationary character of the inner shaft, the inner shaft is suitable to provide a stop surface for the urging element. The urging element can push towards the stop surface wherein the stop surface can prevent axial displacement of the urging element in a direction facing towards the stop surface. The urging element is typically configured for urging the coupling structure in axial direction of the inner shaft facing away from the stop surface. In a further possible embodiment, the urging element can be clamped between the stop surface and an engaging surface of the coupling structure. Such engaging surface would typically face away from at least the conical part of the coupling structure. The presence of an engaging surface enables the the urging element to directly axially displace the coupling structure. This may enhance the efficiency of the operating mechanism. It is conceivable that the urging element is connected to the stop surface and/or the engaging surface. However, it is also conceivable that the urging element merely engages the stop surface and/or the engaging surface.

The urging element may be formed, for example, by a coil spring surrounding the substantially stationary inner shaft. Preferably, the diameter of the coil spring is (slightly) larger than or substantially equal to the outer diameter of the inner shaft.

Such coil spring is typically configured for resiliently forcing the coupling structure in axial direction. The use of a coil spring is a relatively simple and cost efficient solution. The use of a coil spring surrounding the substantially stationary inner shaft may additionally result in an efficient spatial positioning of components. It is also advantageous if the inner diameter of the cylindrical part of the coupling structure, if applied, substantially equals or is slightly larger than the outer diameter of the coil spring.

It is possible that the operating mechanism comprises a substantially stationary support structure which is connected to, or connectable to, the substantially stationary inner shaft and which is configured for connecting the operating mechanism to the fixed world, such as a frame or ceiling. Such substantially stationary support structure can contribute to the ease of use of the operating mechanism. Further, it may contribute to the stationary character of part of the operating mechanism via providing support for, for example, the inner shaft.

Possibly, the operating mechanism comprises at least one adjusting structure configured to enable adjusting of the maximum axial displacement of the coupling structure and/or to limit the axial displacement of the coupling structure. Adjusting the maximum axial displacement of the coupling structure can influence the axial force experienced by the coupling structure due to it being urged by the urging element. Hence, this axial force can for example also be influenced by the spring force of the urging element. Influencing the axial force has subsequently influence onto the radial force of the brake shoe and thus onto the eventual braking force. Hence, the presence of an adjusting element can further contribute to the controllability of the extend wherein the rotation of the drive shaft can be impeded by the brake shoe. The desired maximum axial displacement of the coupling element depends on several variables, such as the dimensions of the window covering and the components of the operating mechanism. A non-limiting example is a maximum axial displacement of 10 millimeters, preferably 7 millimeters, more preferably 5 millimeters. However, it is also conceivable that the maximum axial displacement of the coupling structure is below 4 millimeters or even below 3 millimeters. At least part of the adjusting structure can be substantially cylindrical. It is conceivable the adjusting structure comprises at least one limiter configured for limiting the axial displacement of the coupling structure. Such limiter could for example a limiting surface configured for co-action with part of the coupling structure. If applied, is possible that the outer diameter of the cylindrical part of the coupling structure substantially equals an inner diameter of at least part of the adjusting structure. The adjusting structure is preferably substantially stationary during use of the operating mechanism. In particular, the adjusting structure is configured to be substantially stationary at least during rotation of the drive shaft. The adjusting structure could typically only be axially and/or rotationally displaced during (manual) adjusting thereof, which is typically done in a stationary situation of the window covering, for example prior to use. The adjusting structure is in a preferred embodiment at least partially enclosed between the coupling structure and the drive shaft. This may further contribute to a compact design of the operating mechanism. Further, the drive shaft can provide a protective function for the adjusting structure. In a further preferred embodiment, the adjusting structure can be positioned at a predetermined distance from at least the drive shaft in order to prevent direct engaging between the adjusting structure and the drive shaft. Such direct contact could negatively influence operation of the operating mechanism and/or the controllability of the brake force. It could further lead to undesired wear of components. Preferably, the adjusting structure is at least partially enclosed between the coupling structure and the drive shaft. In this manner, the adjusting structure can efficiently co-act with the coupling structure whilst at least partially shielding the coupling structure from the drive shaft.

In yet a further preferred embodiment, it is conceivable that an inner surface of the adjusting structure comprises at least one slot and that the coupling structure comprises at least one protrusion configured for corporation with said slot, or vice versa. Hence, it is also possible that the co-action is reversed and that the coupling structure comprises at least one slot and that an inner surface of the adjusting structure comprises at least one protrusion configured for corporation with said slot. Such slot and protrusion combination can provide corporation between the coupling structure and the adjusting structure in a relatively simple manner. The slot may for example be a substantially elongated slot. It is also conceivable that the slot forms part of a winding of a screw tread. Hence, it is possible that mutual axial (vertical) displacement of the coupling structure and the adjusting structure can be achieved by rotating the adjusting structure with respect to the coupling structure, or vice versa. In line with the indicated above, adjusting of the mutual axial displacement of the coupling structure and the adjusting structure can adapt the maximum possible axial displacement of the coupling structure as such, thereby subsequently influencing the brake force. It is possible that the adjusting structure comprises at least one adjusting element for preferably manually adjusting the possible maximum axial displacement of the coupling structure. The adjusting element is preferably configured for manually adjusting the possible maximum axial displacement of the coupling structure via rotation of said adjusting element. The adjusting element may be at least partially positioned outside of the drive shaft. This would enable easy manual operation of the adjusting element. The adjusting element could for example be formed by part of a flange protruding in a radial direction from the (substantially cylindrical) adjusting structure.

In a preferred embodiment, at least one brake shoe is at least partially flexible. The brake shoe being at least partially flexible can positively influence the transfer of forces from the coupling structure to the drive shaft. It is for example possible that flexibility of the brake shoe is obtained by providing cut out portions in the brake shoe, preferably at a side of the brake shoe which is not in contact with the drive shaft. This embodiment is also rather material efficient. A further preferred embodiment provides at least one brake shoe which is at least partially ring shaped. An at least partially ring shaped brake shoe is in particular suitable for corporation with the conically shaped part of the coupling structure. The brake shoe could for example be an open ring. Such open ring could be positioned substantially around the conically shaped part of the coupling structure. Preferably the brake shoe substantially clampingly engages the conically shaped part of the coupling structure. It is also beneficial if at least an inner surface of at least one brake shoe is substantially conically shaped. At least part of the inner surface of the brake shoe could for example substantially follow the slope, or inclination, of the conically shaped part of the coupling structure. With such embodiment, the transfer of in particular the axial forces to could be further optimized. When it is referred to the inner surface of the brake shoe, this can for example be the inner edge of the ring shaped brake shoe. Possibly, the outer surface of at least one brake shoe is substantially flat. Herewith a relatively large contact surface can be obtained configured for contact between the brake shoe and the drive shaft. A relatively large contact surface may improve the consistency and/or controllability of the braking action. It is also conceivable that at least part of the outer surface of at least one brake shoe is profiled. The outer surface could for example be at least partially structured and/or roughened. By using such embodiment the extend wherein the rotation of the drive shaft is impeded by the brake shoe can be further controlled. The operating mechanism is in a preferred embodiment substantially free of bearings. This is beneficial as the presence of bearings could negatively influence the controllability of the braking force and thus the controllability of the extend wherein rotation of the drive shaft can be impeded by the brake shoe.

In a preferred embodiment, the axially rotatable drive shaft is configured to cooperate with a winding tube which at least partly surrounds said drive shaft, and wherein the winding tube is configured such that at least a part of the window covering can be wound onto it. The winding tube is likewise axially rotatable. Non-limiting examples of a window covering are a window screen and a window blind. The window covering could for example be attached to the winding tube. The winding tube may even surround the axially rotatable drive shaft substantially completely. The winding tube provides a protective function for the further components of the operating mechanism. Additionally, such embodiment is also advantageous from aesthetic point of view. It is possible that an inner surface of the winding tube comprises at least one coupling element and wherein an outer surface of the drive shaft comprises at least one counter-coupling element configured for corporation with said coupling element of the winding tube, such that rotation of the winding tube results in rotation of the drive shaft and vice versa. In case a window covering is attached to the winding tube, raising and/or lowering of the window covering will cause rotation of the winding tube and thus also of the drive shaft.

It is beneficial if the operating mechanism comprises at least one torsion spring configured for (directly or indirectly) exerting a torque on the drive shaft, and/or winding tube if applied, during rotation of the drive shaft, and/or winding tube, in a direction opposite to the direction of rotation (of the drive shaft and/or winding tube). The torsion spring is preferably wound around the substantially stationary inner shaft, or an (possibly non-stationary) extension thereof, in a direction opposite to the unwinding direction of the window covering. During unwinding of the window covering, the torsion spring is wound around the inner shaft, or an extension thereof, such that this part of the torsion spring exerts a moment on said inner shaft, or the extension thereof. The use of at least one torsion can contribute to the controllability and/or (internal) equilibrium of the operating mechanism. It may in particular contribute to obtain a more balanced operating mechanism. The force exerted by the torsion spring depends for example on the length over which the torsion spring is wound around the drive shaft. The torsion spring could for example be a spiral spring. It is also conceivable that a series of torsion springs is applied. This can be beneficial in order to enhance the adaptability of the operating mechanism. In a further possible embodiment, the torsion spring comprises an axially rotatable housing configured for co-action with the drive shaft and/or winding tube if applied. Hence, the torsion spring can be coupled to the substantially stationary inner shaft, or an extension thereof and to the axially rotatable housing.

In a yet further possible embodiment it is possible that the substantially stationary inner shaft is coupled to an inner spring shaft of the torsion spring through at least one decelerating transmission, which decelerating transmission is configured to rotate the inner spring shaft during rotation of the drive shaft and/or winding tube, preferably in a direction equal to the direction of rotation of the drive shaft and/or winding tube. The inner spring shaft is a non-limiting example of an extension of the inner shaft as mentioned above. The term deceleration (transmission) is used as the obtained rotational speed of the inner spring shaft is decelerated when compared to the rotational speed of the drive shaft and/or winding tube. When comparing to the substantially stationary inner shaft the rotational speed of the inner spring shaft is evidently increased. Hence, also the term acceleration transmission could have been used. A benefit of the use of a decelerating transmission is that a more (space) efficient operating mechanism can be obtained. The decelerating transmission can for example be a planetary transmission. The decelerating transmission can for example be configured to provide a 1:4 deceleration. However, it is also conceivable that a 1:3, 1:2 or 1:5 deceleration can be obtained via use of the deceleration transmission.

Preferably, the inner spring shaft is substantially in line with the substantially stationary inner shaft. In other words, the inner spring shaft is located at an extension of said inner shaft. This is beneficial for the stability of the operating mechanism and thus the window covering device as such.

The invention also relates to an assembly of a window covering and at least one operating device according to any of the previous claims. Any of the abovementioned embodiment can be applied within such cordless assembly. The advantages of such an assembly have already been extensively discussed in the foregoing with respect to the operating mechanism.

BRIEF DESCRIPTION OF DRAWINGS

The invention will be elucidated on the basis of the non-limitative exemplary embodiments shown in the following figures. Within these figures, similar reference numbers correspond to similar or equivalent technical features.

DETAILED DESCRIPTION OF EMBODIMENTS

Figure 1A:
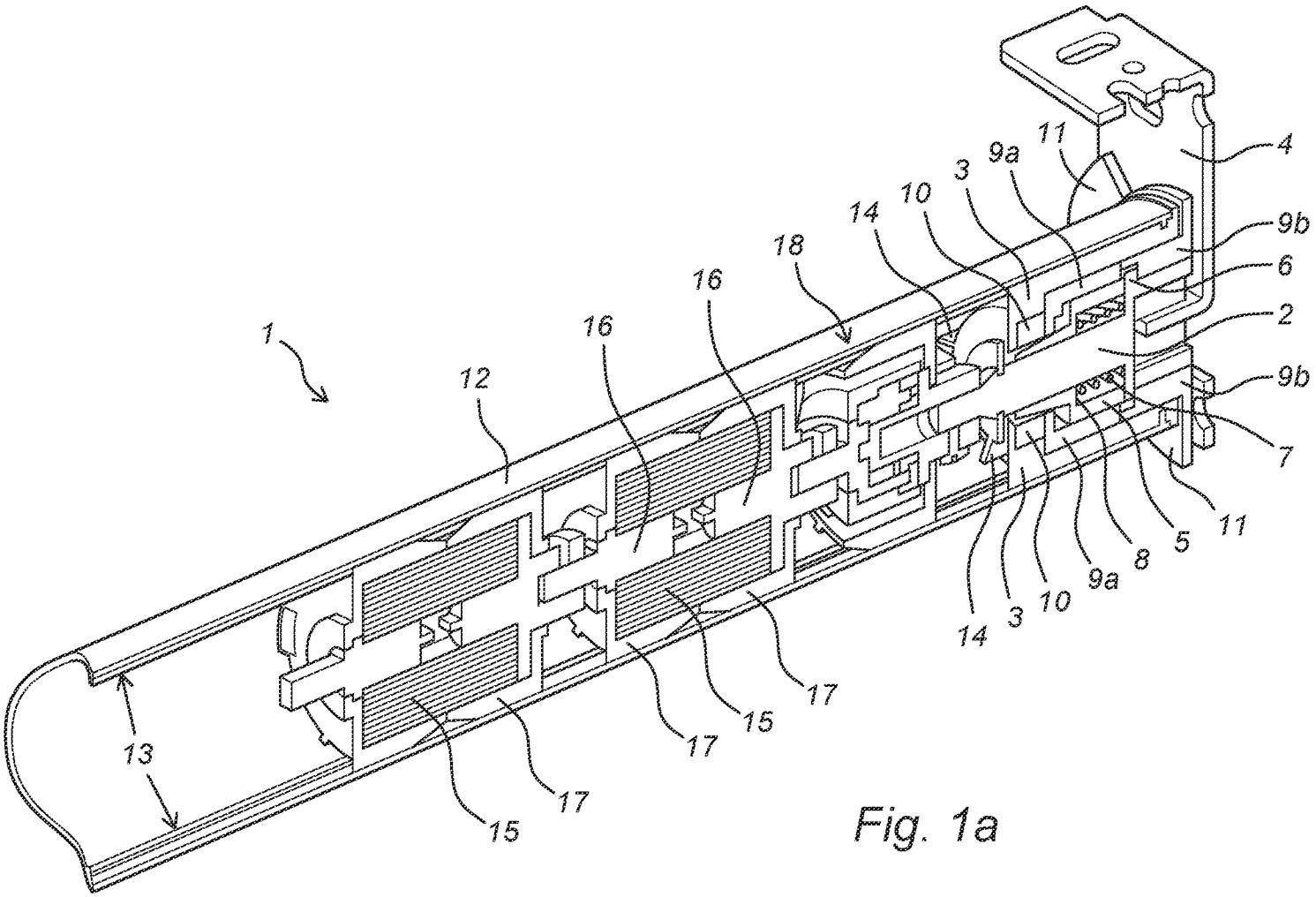
FIG. 1*a* shows a perspective view of a cross section an operating mechanism 1 according to the present invention.

FIG. 1*a* shows a perspective view of a cross section an operating mechanism 1 according to the present invention. The operating mechanism 1 is in particular an operating mechanism 1 for a cordless window covering (not shown) such as a cordless roller blind or a cordless roller shade. The operating mechanism 1 comprises a substantially stationary inner shaft 2 in combination with an axially rotatable drive shaft 3. The substantially stationary inner shaft 2 is connected to a support structure 4 which is connectable to the fixed world. The axially rotatable drive shaft 3 is configured for driving and thereby lowering and/or raising the window covering. The drive shaft 3 encloses at least part of the inner shaft 2. The operating mechanism 1 of the shown embodiment further comprises a coupling structure 5 which is partially conically shaped and which encloses part of the inner shaft 2. The inner shaft 2 comprises a stop surface 6 configured to form a stop for an urging element 7. The urging element 7, in the shown embodiment formed by a coil spring 7, is configured for urging the coupling structure 5 in axial direction of the inner shaft 2 facing away from the support structure 4. The urging element 7 surrounds the inner shaft 2. The urging element 7 co-acts with both the stop surface 6 of the inner shaft 2 and with an engaging surface 8 of the coupling structure 5. In fact, the urging element 7 is clamped between said stop surface 6 and said engaging surface 8. The coupling surface 5 has a predetermined axial play, typically of a couple millimetres. This is due to the coupling structure 5 being restricted in its axial movement by the stop surface 6 of the inner shaft 2 and a boundary formed by the drive shaft 3 and/or an adjusting structure 9. The operating mechanism 1 further comprises a brake shoe 10 which is configured to engage part of the coupling structure 5, in particular the conical part of the coupling structure 5. The brake shoe 10 is positioned such that when the urging element 7 urges the coupling structure 5 in axial direction (seen from the inner shaft 2) the brake shoe 10 experiences a radially outward force. Due to said radially outward force the brake shoe 10 engages the axially rotatable drive shaft 3. Due to said engagement between the brake shoe 10 and the drive shaft 3, the drive shaft 3 is slowed down during rotation thereof. Hence, the brake shoe 10 directly cooperates with both the conical part of the coupling structure 5 and the drive shaft 3. The adjusting structure 9 is configured for adjusting the position of the coupling structure 5 and therefore for adjusting the extend of deceleration which can be achieved by the brake shoe 10. In the shown embodiment, the adjusting structure 9 comprises mutually coupled adjusting parts 9*a*, 9*b*. The adjusting structure 9 is typically substantially stationary, in particular during raising and/or lowering of the window covering. However, the adjusting structure 9 can be (manually) displaced, in particular rotated, such that the possible maximum axial displacement of the coupling structure 5 can be adjusted. Further, the adjusting structure 9 comprises control elements 11 for manually controlling the brake force. The axially rotatable drive shaft 3 cooperates with a winding tube 12 which at least partly surrounds said drive shaft 3. The winding tube 12 is configured such that at least a part of the window covering (not shown) can be wound onto it. An inner surface of the winding tube 12 comprises at least one coupling element 13 and an outer surface of the drive shaft 3 comprises at least one counter-coupling element 14. The coupling element 13 and counter-coupling element are configured for mutual cooperation such that during rotation of the winding tube 12, typically via pulling or raising the window covering, the winding tube 12 takes along the drive shaft 3 in its rotation. Further, the operating mechanism 1 comprises a plurality of torsion springs 15 configured for exerting a torque on the drive shaft 3 and/or winding tube 12 during rotation of the drive shaft 3 and/or winding tube 12 in a direction opposite to the direction of rotation (of the drive shaft 3). Each torsion spring 15 is in the shown embodiment coupled to an inner spring shaft 16 and to (an) axially rotatable housing 17 which is in the shown embodiment configured for co-action with the winding tube 12. In another conceivable embodiment the torsion springs 15 could for example be directly coupled to the substantially stationary inner shaft 2. However, in the shown embodiment the torsion springs are coupled to the substantially stationary inner shaft through an decelerating transmission 18. The decelerating transmission 18 is configured to rotate the inner spring shaft 16 during rotation of the drive shaft 3 and/or winding tube 12. The decelerating transmission 18 is in particular a planetary transmission, more in particular to provide a 1:4 deceleration.

Figure 1B:
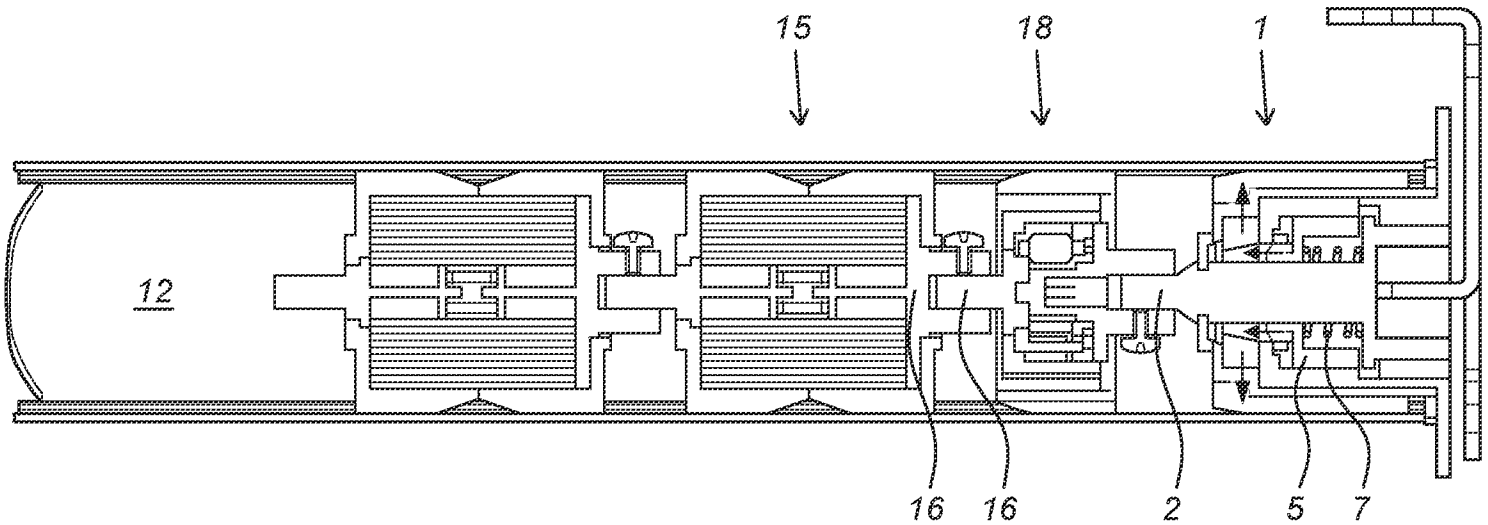
FIG. 1*b* shows the cross section of the operating mechanism as shown in FIG. 1*a* from a side view.

FIG. 1*b* shows the cross section of the operating mechanism 1 as shown in FIG. 1*a* from a side view. It can be seen that the inner spring shaft 16 is substantially in line with the substantially stationary inner shaft 2. The arrows indicate the axial and radial forces as exerted as a result of the continuous urging of the coupling structure 3 by the urging element 7. The substantially stationary inner shaft 2 has several different radial cross sections depending on which component the inner shaft 2 is co-acting with.

FIGS. 2*a*-2*e* show a series images of the operating mechanism 1 as shown in FIGS. 1*a* and 1*b* wherein subsequently an element is peeled off the operating mechanism 1 such that the co-action between the elements can be seen.

Figure 2A:
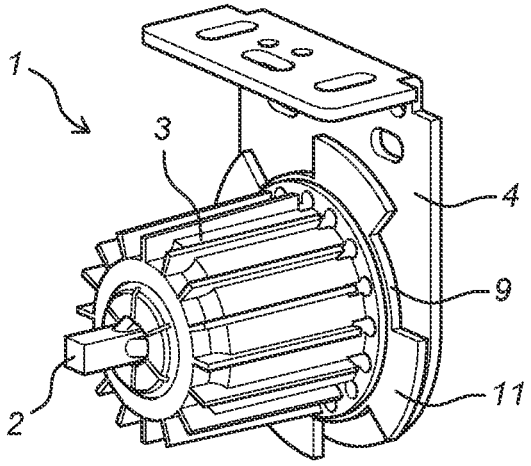
FIGS. 2*a*-2*e* show a series images of the operating mechanism as shown in FIGS. 1*a* and 1 *b*.

FIG. 2*a* shows the drive shaft 3 which encloses part of the inner shaft 2. In the shown embodiment, the drive shaft 3 encloses the coupling structure, the brake shoe and the urging element substantially entirely. The adjusting structure 9 is partially enclosed by the drive shaft 3. The drive shaft 3 has a structured outer surface configured for corporation with an inner side of a winding tube (not shown).

Figure 2B:
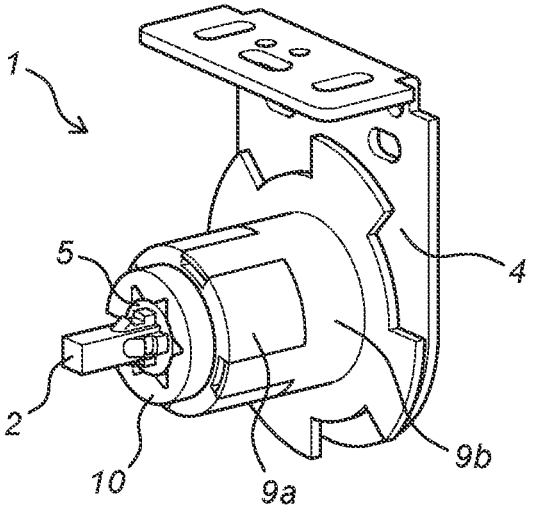

In FIG. 2*b* the drive shaft is removed, such that the further parts of the adjusting structure 9*a*, 9*b* can be seen. Further the brake shoe 10 is visible, which encloses the coupling structure 5. It can be seen that the adjusting parts 9*a*, 9*b* of the adjusting structure 9 are mutually coupled via a snap connection. Part of the outer surface of the adjusting structure 9 forms a cylinder. This cylindrically shaped part of the adjusting structure 9 preferably does not engage the drive shaft.

Figure 2C:
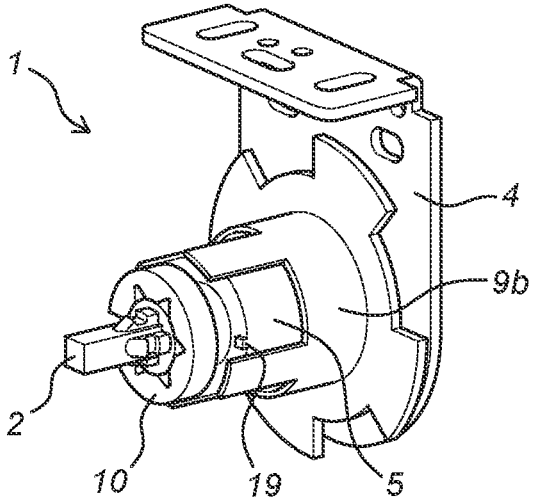

In FIG. 2*c* the more centrally located adjusting part 9*a* is made invisible. It can be seen that the coupling structure 5 comprises a protrusion 19 which is configured for corporation with a slot (not shown) provided in the adjusting structure 9. Rotation of the adjusting structure 9 via the adjusting element 11 will cause the slot to take along the protrusion 19, thereby adjusting the maximum axial displacing of the coupling structure 5.

Figure 2D:
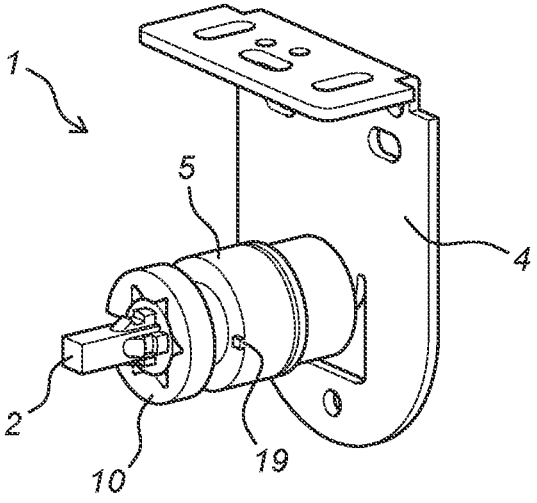

FIG. 2*d* shows an embodiment wherein the rear part 9*b* of the adjusting structure 9 is made invisible. It can be seen that the inner shaft 2 comprises a stop surface 6. The stop surface 6 also substantially forms an axial boundary for the coupling structure 3.

Figure 2E:
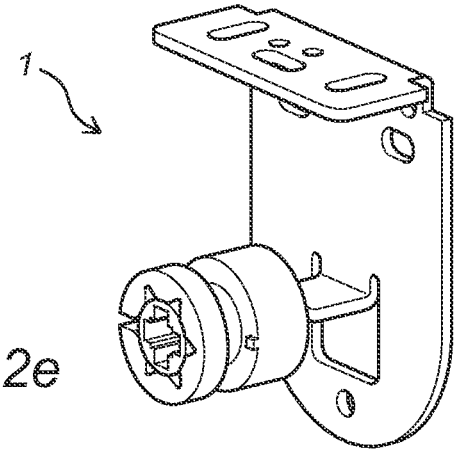

FIG. 2*e* shows that an inner surface of the conically shaped part of the coupling structure 5 has a non-cylindrical shape. This non-cylindrical is complementary to the non-cylindrical shape of part of the inner shaft which co-acts with said conical part of the coupling structure 5. In the shown embodiment an substantially cross-shaped shaft part was applied, and the coupling part 9 substantially follows the contours thereof. Such complementary shapes may prevent rotation of the coupling structure 5, in particular with respect to the inner shaft. Preferably, part of the inner shaft 2 which co-acts with the urging element 7, in particular the coil spring 7, is substantially cylindrical.

Figure 3A:
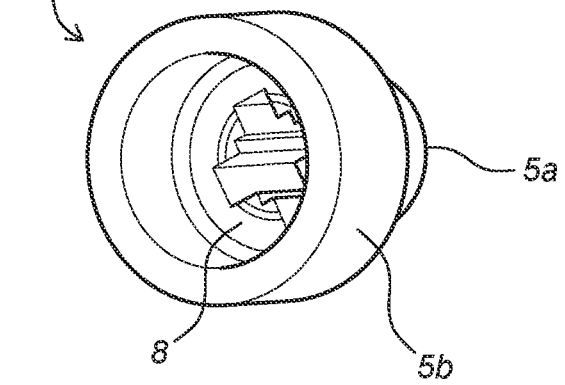
FIGS. 3*a* and 3*b* show perspective views of a possible embodiment of a coupling structure for use in an operating mechanism.
Figure 3B:
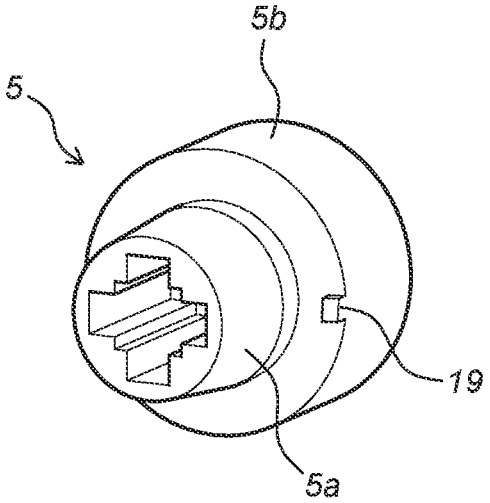

FIGS. 3*a* and 3*b* show perspective views of a possible embodiment of a coupling structure 5 for use in an operating mechanism 1 according to the present invention. The coupling structure 5 comprises both a substantially conical part 5*a* and a substantially cylindrical part 5*b*. The figures further show that the coupling structure 5 comprises an engaging surface 8 configured for engaging by the urging element (not shown).

Figure 4A:
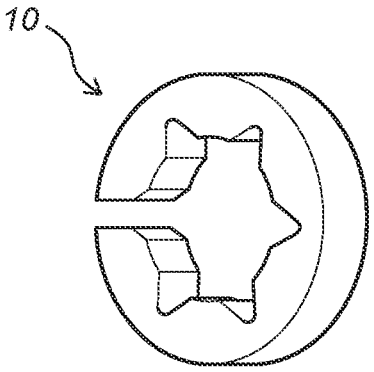
FIG. 4*a* shows a perspective view of a possible embodiment of a brake shoe for use in an operating mechanism according to the present invention.
Figure 4B:
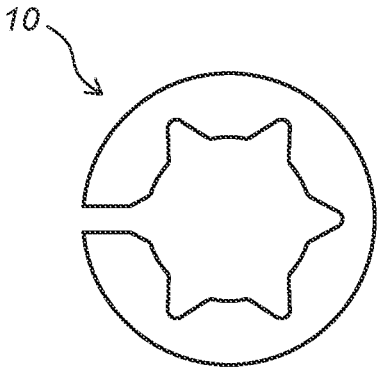
FIG. 4*b* shows a frontal view of the brake shoe.

FIG. 4*a* shows a perspective view of a possible embodiment of a brake shoe 10 for use in an operating mechanism 1 according to the present invention. FIG. 4*b* shows a frontal view said brake shoe 10. The brake shoe 10 of the shown embodiment is substantially ring shaped, the brake shoe 10 is in particular an open ring. The inner surface of the brake shoe 10 is substantially conically shaped. FIG. 2*e* for example shows that the brake shoe 10 substantially follows the slope of the conically part of the coupling structure 5. The inner side of the brake shoe 10 is provided with cut out portion which might enhance the flexibility of the brake shoe 10. The outer surface of said brake shoe 10 is in the shown embodiment substantially flat.

It should be clear that the invention is not limited to the exemplary embodiments shown and described here, but that within the scope of the appended claims, many variants are possible which will be obvious to the person skilled in the art. It is hereby conceivable that various inventive concepts and/or technical features of the embodiments described above can be combined in whole or in part without departing from the inventive concept described in the appended claims.

The verb 'comprising' and its conjugations included in this patent are not only understood to mean 'comprising', but are also to be understood as the expressions 'contain', 'essentially consist, 'formed by', and conjugations thereof.

Further, when it is referred to a 'brake shoe' also the term 'brake element' could have been used. Also the terms 'operating mechanism' and 'operating device' or 'operating system' are interchangeable. Where the term 'coupling structure' is used, there can also be referred to a 'coupling element'. When it is said that the brake shoe is configured to impede rotation of the axially rotatable drive shaft, it is also meant that the brake is configured for braking or slowing down the rotation of the axially rotatable drive shaft.

The invention claimed is:

1. Operating mechanism for a cordless window covering such as a roller blind, comprising:

at least one stationary inner shaft which is connectable to a fixed world, at least one at least partially conically shaped coupling structure which encloses at least part of the inner shaft, at least one urging element configured for urging the coupling structure in an axial direction of the inner shaft, at least one axially rotatable drive shaft configured for driving and thereby lowering and/or raising the window covering, wherein the drive shaft encloses at least part of the inner shaft and the coupling structure, and at least one brake shoe configured to cooperate with at least the conically shaped part of the coupling structure and with the axially rotatable drive shaft, wherein the brake shoe, the coupling structure and the drive shaft are positioned such that axial urging of the coupling structure by the urging element causes a radially outward force onto the brake shoe causing the brake shoe to at least partially impede rotation of the axially rotatable drive shaft.

2. Operating mechanism according to claim 1, wherein the urging element is configured for urging the coupling structure in axial direction of the inner shaft towards a center of the window covering.

3. Operating mechanism according to claim 1, wherein the coupling structure is positioned such that an outer diameter of at least the conically shaped part of the coupling structure decreases in the direction wherein it is axially urged by the urging element.

4. Operating mechanism according to claim 1, wherein at least part of the inner shaft has a non-cylindrical shape and wherein an inner surface of the coupling structure has a complementary non-cylindrical shape.

5. Operating mechanism according to claim 1, wherein the coupling structure comprises a cylindrical part configured to enclose at least part of the urging element.

6. Operating mechanism according to claim 1, wherein the stationary inner shaft comprises at least one stop surface configured to form a stop for the urging element.

7. Operating mechanism according to claim 1, wherein the urging element is clamped between a stop surface and an engaging surface of the coupling structure.

8. Operating mechanism according to claim 1, wherein the urging element is formed by a coil spring surrounding the stationary inner shaft.

9. Operating mechanism according to claim 1, comprising a stationary support structure which is connected to the stationary inner shaft and which is configured for connecting the operating mechanism to the fixed world.

10. Operating mechanism according to claim 1, comprising at least one adjusting structure configured to enable adjusting of a maximum axial displacement of the coupling structure and/or to limit the axial displacement of the coupling structure, wherein the adjusting structure is at least partially enclosed between the coupling structure and the drive shaft and/or wherein an inner surface of the adjusting structure comprises at least one slot and wherein the coupling structure comprises at least one protrusion configured for cooperation with said slot.

11. Operating mechanism according to claim 1, wherein the at least one brake shoe is at least partially flexible.

12. Operating mechanism according to claim 1, wherein the at least one brake shoe is at least partially ring shaped.

13. Operating mechanism according to claim 1, wherein at least an inner surface of the at least one brake shoe is conically shaped.

14. Operating mechanism according to claim 1, wherein an outer surface of the at least one brake shoe is flat.

15. Operating mechanism according to claim 1, wherein an outer surface of the at least one brake shoe is profiled.

16. Operating mechanism according to claim 1, wherein the operating mechanism is free of bearings.

17. Operating mechanism according to claim 1, wherein the axially rotatable drive shaft is configured to cooperate with a winding tube which at least partly surrounds said drive shaft, and wherein the winding tube is configured such that at least a part of the window covering can be wound onto it.

18. Operating mechanism according to claim 17, wherein an inner surface of the winding tube comprises at least one coupling element and wherein an outer surface of the drive shaft comprises at least one counter-coupling element configured for corporation with said coupling element of the winding tube, such that rotation of the winding tube results in rotation of the drive shaft, and vice versa.

19. Operating mechanism according to claim 1, comprising at least one torsion spring configured for exerting a torque on the drive shaft, and/or winding tube if applied, during rotation of the drive shaft, and/or winding tube, in a direction opposite to the direction of rotation.

20. Assembly of a window covering and an operating device according to claim 1.

* * * * *